United States Patent [19]

Burgo et al.

[11] Patent Number: 5,031,688

[45] Date of Patent: Jul. 16, 1991

[54] METHOD AND APPARATUS FOR CONTROLLING THE THICKNESS OF METAL STRIP CAST IN A TWIN ROLL CONTINUOUS CASTING MACHINE

[75] Inventors: Jonathan A. Burgo, Bethlehem; Dennis H. Bright, Allentown; Thomas J. Conarty, Jr., Lehighton; Jack H. Baker; Joseph W. Hlinka, both of Bethlehem, all of Pa.

[73] Assignee: Bethlehem Steel Corporation, Bethlehem, Pa.

[21] Appl. No.: 449,659

[22] Filed: Dec. 11, 1989

[51] Int. Cl.[5] ..... B22D 11/06; B22D 11/16

[52] U.S. Cl. ..... 164/452; 164/480; 164/428

[58] Field of Search ..... 164/452, 454, 480, 154, 164/413, 428

[56] References Cited

U.S. PATENT DOCUMENTS

| | | | |
|---|---|---|---|
| 3,263,284 | 8/1966 | Orr | 164/448 |
| 3,570,713 | 0/1971 | Tromel | 222/1 |
| 3,587,708 | 6/1971 | Khimich | 164/480 |
| 3,766,763 | 0/1973 | Cofer et al. | 72/13 |
| 4,546,814 | 10/1985 | Shibuya | 164/428 |
| 4,674,556 | 6/1987 | Sakaguchi | 164/480 |
| 4,678,023 | 7/1987 | Knapp | 164/480 |
| 4,702,300 | 10/1987 | Nakanori | 164/428 |
| 4,784,209 | 0/1988 | Hlinka et al. | 164/428 |

FOREIGN PATENT DOCUMENTS

| | | | |
|---|---|---|---|
| 56-91967 | 7/1981 | Japan | 164/480 |
| 62-252643 | 11/1987 | Japan | 164/428 |
| 2087100 | 5/1982 | United Kingdom | 164/428 |

*Primary Examiner*—Richard K. Seidel
*Assistant Examiner*—Rex E. Pelto
*Attorney, Agent, or Firm*—John I. Iverson

[57] ABSTRACT

A method and apparatus for controlling the thickness of a metal strip cast by pouring molten metal between a pair of closely spaced, water-cooled rotating rolls. The temperature of at least one of the rolls is measured at a fixed position relative to the roll bite before and during the cast. The rotational speed of the rolls is adjusted in proportion to a measured roll separation or roll separating force corrected by the roll temperature measured during the cast such that a predetermined and substantially uniform thickness of the metal strip is produced.

12 Claims, 4 Drawing Sheets

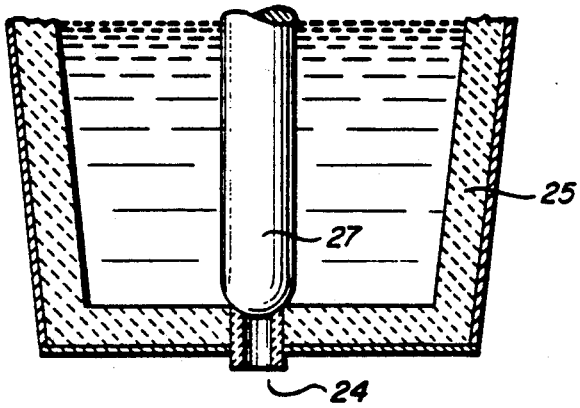
FIG. 1
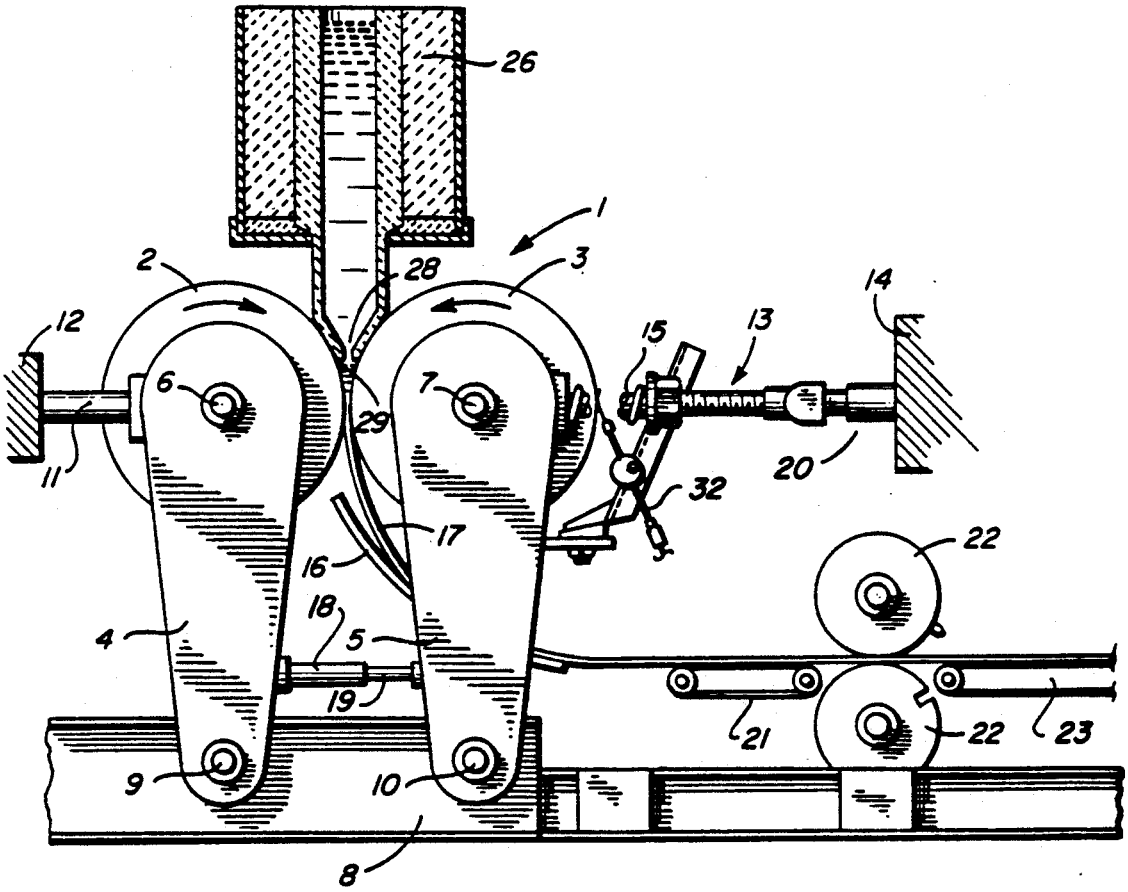

METHOD AND APPARATUS FOR CONTROLLING THE THICKNESS OF METAL STRIP CAST IN A TWIN ROLL CONTINUOUS CASTING MACHINE

BACKGROUND OF THE INVENTION relates to the continuous casting of molten metals. It relates particularly to the continuous casting of molten metal between a pair of closely spaced, water-cooled rotating rolls whose axes lie horizontal and parallel to each other and rotate in opposite directions. Such continuous casting apparatus is commonly called a twin roll caster.

The continuous casting of molten metal using a twin roll caster is well-known. Such a process and apparatus was described and patented as early as 1865 in U.S. Pat. No. 49,053 to Bessemer. Since 1865 there have been many U.S. and foreign patents describing improvements in Bessemer's twin roll caster but to date, none of these prior twin roll casters have been able to produce long lengths of steel strip of acceptable commercial quality.

U.S. Pat. No. 4,784,209 to Hlinka, et al., assigned to Applicants' assignee, describes a modern twin roll casting apparatus.

One of the problems with prior twin roll casters has been the inability to accurately control the thickness of the metal strip in both the longitudinal and transverse direction as it is cast between the rolls. If the cast metal strip is to be acceptable for commercial use, it should have a predetermined and substantially uniform thickness from beginning to end and from edge to edge.

SUMMARY OF THE INVENTION

It is an object of this invention to provide a method and apparatus for the twin roll casting of metal strip that provides for an accurate and substantially uniform thickness of the cast metal strip in the longitudinal direction.

It is a further object of this invention to provide a method and apparatus for the twin roll casting of metal striP that will automatically make adjustments to the twin roll caster during the cast to maintain a substantially uniform thickness of the metal strip as it is cast.

It has been discovered that the foregoing objectives can be attained by measuring the temperature of at least one of the rolls prior to commencement of the pouring of molten metal between the rolls. The displacement of the rolls and the temperature of at least one of the rolls is then continuously measured while the rolls rotate during the pouring of the molten metal between them. The rotational speed of the rolls is adjusted in proportion to the changes in roll displacement occurring during the cast which are corrected for the thermal expansion of the rolls. An expansion-corrected roll force could also be maintained by roll speed changes to produce a controlled strip thickness.

BRIEF DESCRIPTION OF THE DRAWINGS

FIG. 1 is an elevation view, partly in section of a preferred embodiment of the twin roll casting apparatus of this invention.

DESCRIPTION OF A PREFERRED EMBODIMENT

Figure 2:
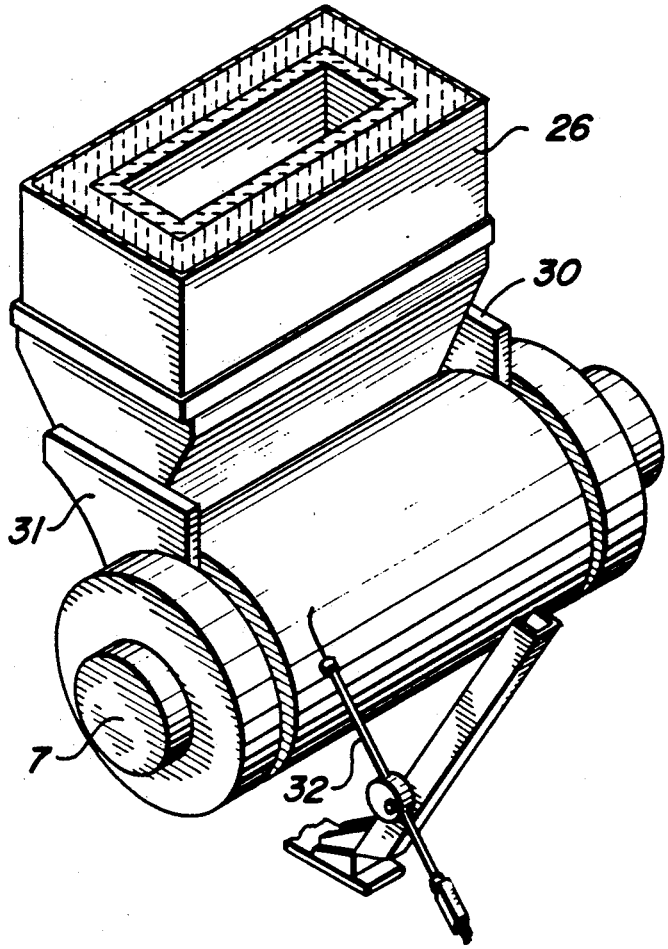
FIG. 2 is an isometric view of one of the rolls of the twin roll casting apparatus of this invention.

FIG. 1 illustrates a preferred embodiment of the continuous casting apparatus of this invention which is designed to cast steel strip in a range of thicknesses between 10 and 100 mils thick at rates of at least 5 tons per hour per foot of width.

The continuous casting apparatus 1 of this invention comprises a pair of closely spaced internally water-cooled rolls 2 and 3 which are about 12 inches in diameter. The rolls 2 and 3 are preferably the same diameter but could be of different diameters, if desired. The rolls 2 and 3 are preferably made of copper and water-cooled to cause a rapid solidification of the molten metal, but could be made of other materials and composites capable of withstanding the temperature involved.

Rolls 2 and 3 are supported in a substantially horizontal plane by having the longitudinal axis of each of the rolls connected to a pair of vertical support members 4 and 5 by bearings 6 and 7. The rolls are rotated in opposite directions as indicated by the arrows by variable speed electric or hydraulic motors (not shown).

The roll support members 4 and 5 are connected to a rigid base member 8 by pins 9 and 10. Links 11 attached to support members 4 and a fixed anchor 12 hold roll 2 in a fixed horizontal position during casting. Links 11 may be disconnected between casts to permit assembly and disassembly of the continuous casting apparatus 1. A pair of adjustable resilient assemblies 13 connect the roll support members 5 which hold casting roll 3 in a horizontal position to a fixed anchor 14. A load cell 20 is used to measure the roll separating force. As shown in FIG. 1, a spring 15 provides the resilient feature of resilient rod assemblies 13.

Directly beneath the twin casting rolls 2 and 3 is a guide chute 16 which guides the newly cast strip 17 from a vertical to a horizontal direction.

During casting, the separation or displacement of the rolls relating to each other is measured by a linear variable differential transformer 18 driven by a plunger 19 mounted on the roll support members 4 and 5.

The continuous casting apparatus 1 is supplied with molten steel from a refractory lined ladle 25 which discharges the molten steel into a refractory lined pouring box 26. The ladle operator maintains a predetermined level of molten steel in the pouring box 26 by controlling the ladle stopper 27.

The pouring box 26 as illustrated in FIG. 1 has a slot 28 as means of distributing the molten steel across the full width of the twin casting rolls 2 and 3 providing a substantially uniform distribution of quiescent molten steel into a molten steel pool 29 between the casting rolls 2 and 3. The molten steel pool 29 is maintained between the casting rolls 2 and 3 by refractory edge dams 30 and 31 (shown in FIG. 2) similar to those described in Bessemer's U.S. Pat. No. 49,053.

In Bessemer's arrangement, and others who followed, the two casting rolls are preset with a gap corresponding to the strip thickness to be cast. In such arrangements the rolls are provided with a sufficient force for the consolidation and subsequent hot rolling of the solidifying strip to a predetermined thickness.

To preset the casting rolls and rely on hot rolling reduction to produce the desired strip thickness, is a serious error due to the lack of a proper understanding of the twin roll casting process.

Casting of steel strip between twin rolls requires continuous operation of the apparatus while temperatures and other parameters vary. The liquid metal in the twin roll caster should be free to solidify at whatever rate as determined by the changing conditions then prevailing. The material cannot be passed through the casting rolls by the application of excessive compressive forces without causing damage to the strip nor allowed to exit the rolls in only a partially solidified state.

In the twin roll casting of strip it is necessary to measure and control the thickness of the strip leaving the rolls to satisfy downstream processing requirements. In the twin roll casting process the thickness of the strip exiting the casting rolls is determined primarily by the rate of flow of liquid metal supplied to the rolls and by the speed of the rolls. In some twin roll casting machines the rolls are spaced to a preset gap. In other twin roll casting machines the rolls are permitted to separate or join during casting. With the first type (force/speed control) the roll separating force is continuously measured during casting and the speed of the rolls is controlled such that the separating force remains within an acceptable range; with the second type (thickness/speed control) the strip thickness is measured and the speed of the rolls is controlled such that the strip thickness remains within an acceptable range.

It has been discovered that with both types of thickness control the preset or measured strip thickness will not be the final as-cast strip thickness because of the thermal expansion of the rolls. For example, the thermal expansion of a 12-inch diameter copper roll at 500° F. above ambient results in a displacement between the rolls of 0.045 inch. In a 12-inch diameter twin roll caster casting strip of less than 0.10 inch in thickness the error in the thickness measurement due to thermal expansion is significant and in this illustration, the error is 45%.

It is the purpose of this invention to reduce or eliminate the deleterious effects of the thermal expansion on the control of the cast strip thickness since the lack of control adversely affects the process yield, productivity and product quality.

The essential features of the preferred embodiment of this invention are to:

(1) measure the roll surface temperature continuously during casting by known means of thermometry, such as a thermocouple, (2) determine the difference between the roll surface temperature during casting and a reference initial temperature of the roll surface prior to casting, (3) multiply the temperature difference by a compensating coefficient to determine the amount of roll expansion, and (4) compensate for the expansion of the roll in the following ways:

To compensate for the thermal expansion in the force/speed control mode of machine operation the separation of the rolls is not fixed but varied from the prefixed setting during casting in the amount determined in (3) while the force/speed control means of this mode of operation remains undisturbed.

To compensate for the thermal expansion in the thickness/speed control mode of machine operation the measured strip thickness is corrected by the amount determined in (3) while the thickness/speed control means of this mode of operation remains undisturbed.

The apparatus used to measure roll displacement in a thickness/speed control mode for a twin roll caster is a linear variable differential transformer (LVDT) 18 mounted on the roll support members 4 and 5. These members separate with the rolls at the start and during casting. The LVDT device 18 transmits a voltage signal proportional to the displacement of the transformer plunger 19 to a microcomputer which translates the voltage signal into a signal corresponding to inches of thickness and transmits this signal to a thickness/speed electronic microprocessor which compares the signal to a known setting corresponding to a desired cast thickness; if the signal is more/less than the desired setting the microprocessor continuously increases/decreases the speed of the rolls until the signal matches the setpoint.

The apparatus used for the preferred temperature measurement for the thickness/speed control for a twin roll caster with the present invention is a sliding contact thermocouple 32 to continuously measure the surface temperature of the roll during casting located between 120°–240°, with 180° being preferred, from the roll bite as shown in FIG. 2. The millivolt signal from the thermocouple is linearized and converted to an analog signal which is sent to a microcomputer which calculates the difference between the roll surface temperature during casting and the roll temperature prior to the cast and calculates (using a compensating coefficient) the amount of roll displacement due to the thermal expansion of the roll. Simultaneously, the LVDT device 18 transmits a voltage signal proportional to the roll displacement to a microcomputer where the signal is translated into an uncorrected strip thickness. The amount of roll displacement due to thermal expansion is then subtracted from the uncorrected strip thickness yielding a corrected true strip thickness. The corrected strip thickness is sent as a signal to a microprocessor. The thickness/speed microprocessor then compares the true thickness signal to a setpoint signal representing the desired strip thickness. If the signal is more or less than the setpoint, the microprocessor will automatically increase or decrease the speed of the rolls until the signals match.

The compensating coefficient is a factor which we found by experiment to be the product of the thermal expansion coefficient and the dimensions of the roll. However, broadly, the compensating coefficient may include other factors such as the location of the thermocouple 32. For a particular installation the compensating coefficient is best established by applying the following equation (1):

$$\text{Compensating Coefficient} = \text{expansion coefficient of the roll material} \times \text{roll diameter} \times \text{"factors"} \quad (1)$$

where the "factors" is a calibration factor determined by comparing the thickness of the strip as measured after the cast to the corrected thickness determined during the cast. The roll displacement, due to the thermal expansion of the rolls, is the product of the roll temperature difference and the compensating coefficient. The roll displacement is subtracted from the uncorrected thickness as determined above to arrive at the corrected, true strip thickness.

EXAMPLE NO. 1.

STRIP THICKNESS CONTROL

Figure 3:
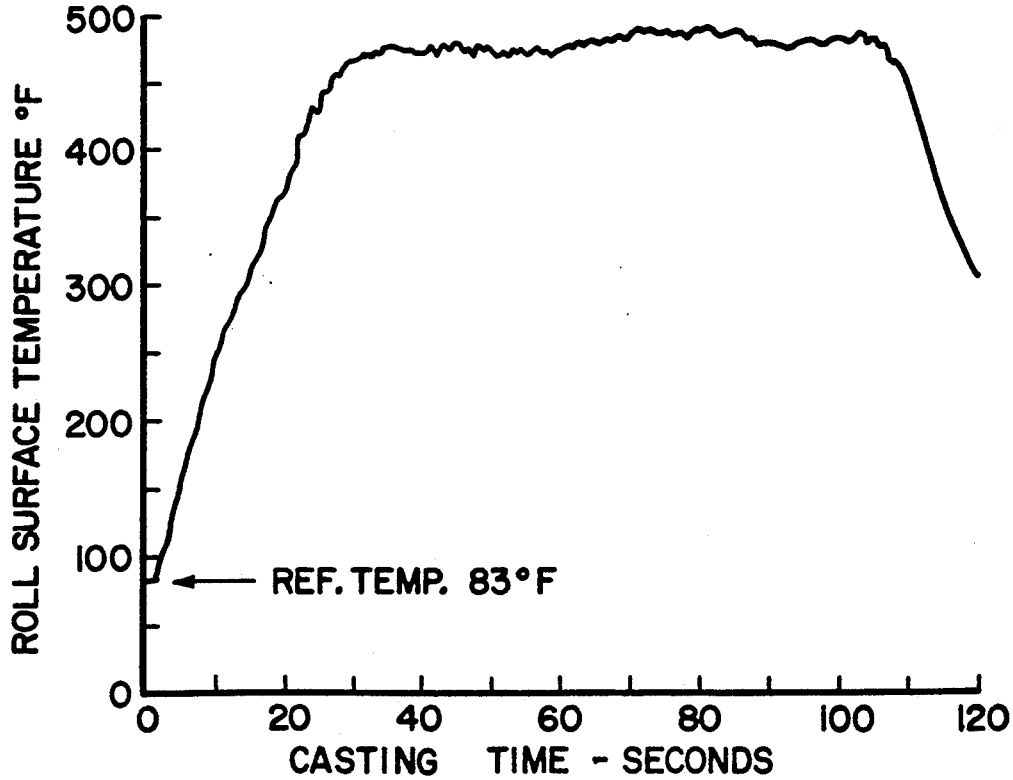
FIG. 3 is a graph showing the surface temperature of one of the rolls of the twin roll casting apparatus of this invention during the casting of molten steel.

FIG. 3 shows the roll surface temperature as measured during a cast. During the first 30 seconds of casting the roll temperature increases from an initial value of 83° F. to about 460° F. During this period the wide variation in the roll temperature represents a wide variation in the corrections to be applied to the uncorrected strip thickness readings.

Figure 4:
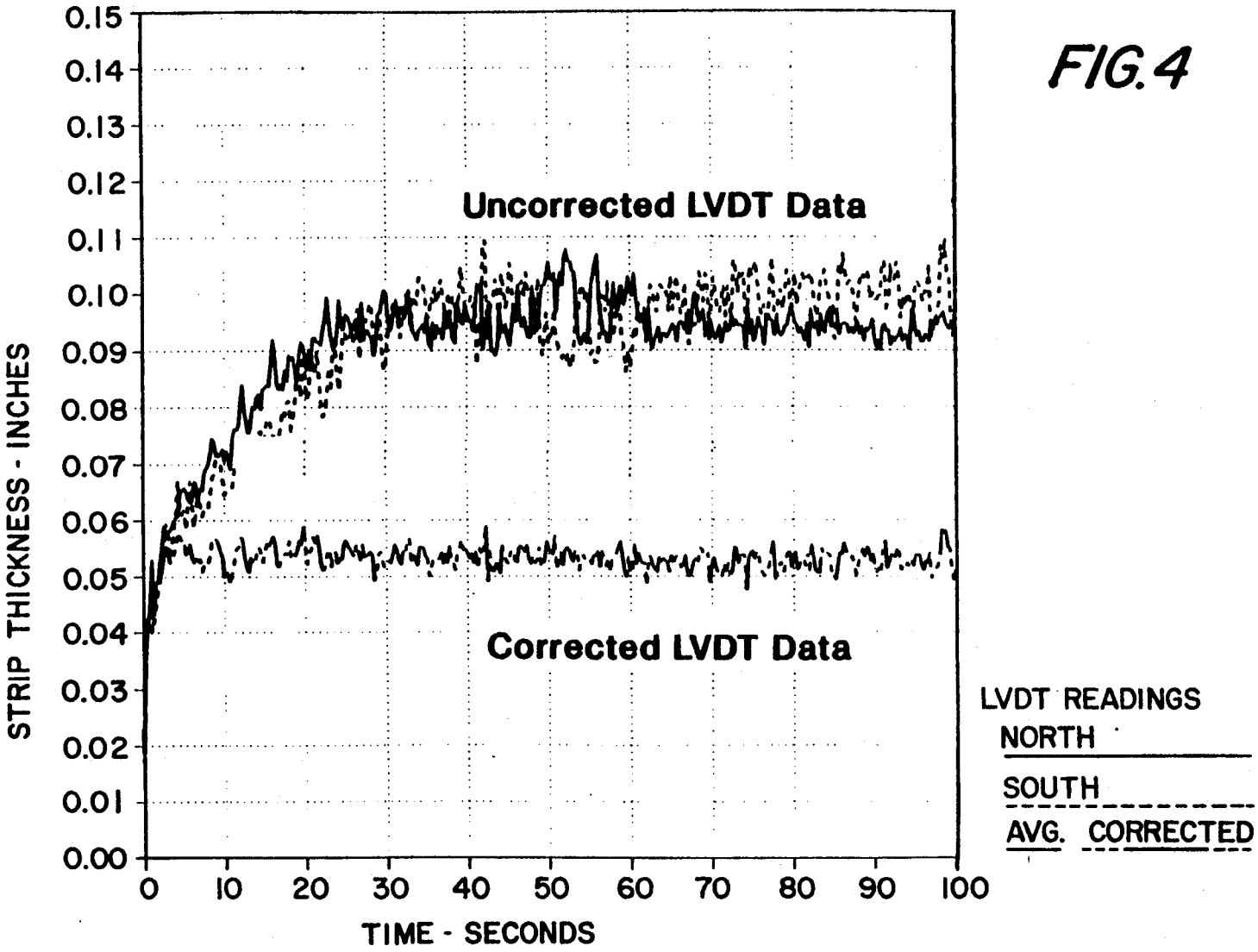
FIG. 4 is a graph showing the thickness of a steel strip as it is cast in a twin roll casting apparatus.

FIG. 4 is a plot of the strip thickness during the cast. One set of curves is shown marked "uncorrected" thickness based on the uncorrected LVDT signals received from the two transducers (18) located on the ends of the rolls; whereas, the lower curve marked "corrected" represents the strip thickness measurement after compensating for the thermal expansion of the rolls. At any instant of time the difference in thickness between the uncorrected and the corrected thickness is the amount of roll separation due to the thermal expansion of the rolls as calculated during the cast based on the roll temperature minus the reference temperature in FIG. 3 and application of Equation (1). It should be noted in this cast the strip thickness as measured prior to correction is in error by about 100%.

Figure 5:
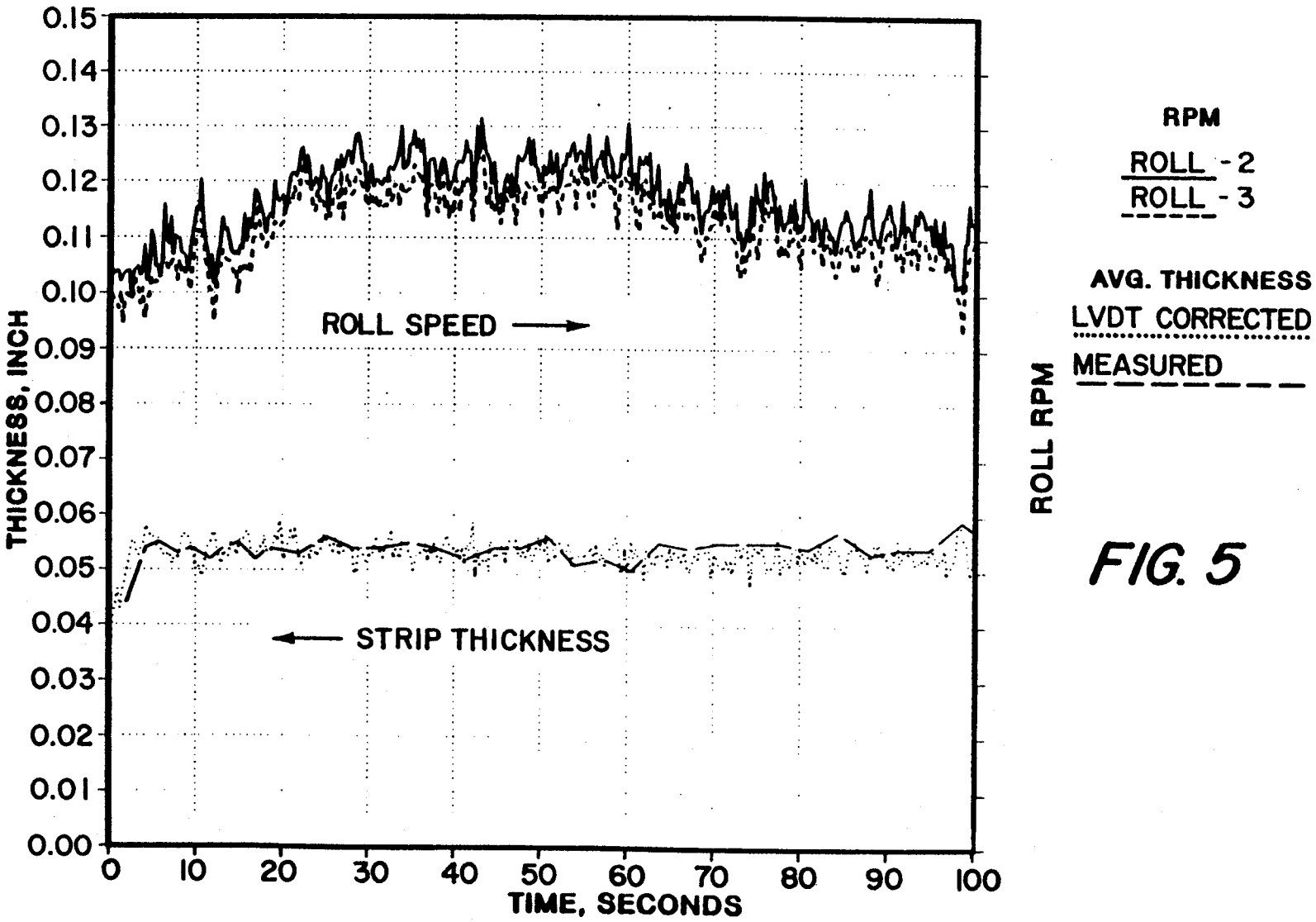
FIG. 5 is a graph showing the effect of casting speed on the thickness of steel strip produced in a twin roll caster using the method and apparatus of this invention.

FIG. 5 shows two sets of curves. The upper set is the speed of the two rolls (designated as 2 and 3) in RPM. The microprocessor/speed controller receiving the corrected thickness signal from the microcomputer adjusted the speed of the rolls during the cast from about 28 RPM to 39 RPM to satisfy the setpoint condition. The result is the corrected thickness measurement shown by the dotted points in the lower curve set. Note the uniformity in the thickness of the strip throughout the duration of the cast. Finally, to demonstrate the excellence of the present invention for the measurement and control of the strip thickness there is in FIG. 5, superimposed on the corrected thickness curve, a broken line curve of the actual, after cast, strip thickness as measured using a micrometer.

An alternate method of controlling thickness is to use the roll force as the controlled process variable (as measured by load cells) rather than the separation itself (as measured by LVDT's). The relationship between roll force and roll separation is a straight line at constant roll temperature. As the roll temperature increases, the roll force increases over that expected from this straight line relationship due to the thermal expansion of the rolls. In this method of control, the measured roll separating force (20) is adjusted by a computed value based on thermal expansion of the rolls, the adjusted value is then continuously compared to the desired setpoint roll separating force, and adjustments to the roll speed are continuously made until the signals match.

We claim:

1. A method for controlling the thickness of a metal strip cast by pouring molten metal between a pair of closely spaced, water-cooled rotating rolls comprising:
   (a) measuring the temperature of at least one of said rolls prior to the commencement of the pouring of the molten metal between the rolls,
   (b) continuously measuring the temperature of at lest one of said rolls at a fixed position relative to the roll bite during the pouring of the molten metal,
   (c) continuously measuring the displacement of the rolls,
   (d) determining the roll displacement due to the thermal expansion of said rolls as a product of a compensating coefficient and the temperature measured in Step (b) relative to the temperature measured in Step (a),
   (e) determining the strip thickness by subtracting the roll displacement of Step (d) from the roll displacement in Step (c),
   (f) comparing the strip thickness determined in Step (e) to a desired setpoint thickness, and
   (g) adjusting the roll speed accordingly to null the difference between the setpoint thickness and the strip thickness determined in Step (e).

2. The method of claim 1 in which the molten metal is steel.

3. The method of claim 1 in which the rolls are copper.

4. The method of claim 1 in which the temperature of the rolls is measured at the external surface of the roll.

5. The method of claim 1 in which the temperature measurements in Steps (a) and (b) are made 120° to 240° from where the molten metal contacts the surface of the roll.

6. The method of claim 1 in which the temperature measurements in Steps (a) and (b) are made 180° from where the molten metal contacts the surface of the roll.

7. A method for controlling the thickness of a metal strip cast by pouring molten metal between a pair of closely spaced, water-cooled rotating rolls comprising:
   (a) measuring the temperature of at least one of said rolls prior to the commencement of the pouring of the molten metal between the rolls,
   (b) continuously measuring the temperature of at least one of said rolls at a fixed position relative to the roll bite during the pouring of the molten metal,
   (c) continuously measuring the roll separating force of the rolls,
   (d) determining the roll separating force due to the thermal expansion of said rolls as a product of a compensating coefficient and the temperature measured in Step (b) relative to the temperature measured in Step (a),
   (e) determining the adjusted roll separating force by subtracting the roll separating force of Step (d) from the roll separating force in Step (c),
   (f) comparing the adjusted roll separating force determined in Step (e) to a desired setpoint roll separating force, and
   (g) adjusting the roll speed accordingly to null the difference between the setpoint roll separating force and the roll separating force determined in Step (e).

8. The method of claim 7 in which the molten metal is steel.

9. The method of claim 7 in which the rolls are copper.

10. The method of claim 7 in which the temperature of the rolls is measured at the external surface of the roll.

11. The method of claim 7 in which the temperature measurements in Steps (a) and (b) are made 120° to 240° from where the molten metal contacts the surface of the roll.

12. The method of claim 7 in which the temperature measurements in Steps (a) and (b) are made 180° from where the molten metal contacts the surface of the roll.

* * * * *